United States Patent [19]

VanDerZee

[11] 4,262,618

[45] Apr. 21, 1981

[54] REMOTE CONTROL STEERING ATTACHMENT FOR A STEERING WHEEL

[76] Inventor: William P. VanDerZee, 3804 S. Wood Dr., Racine, Wis. 53403

[21] Appl. No.: 68,730

[22] Filed: Aug. 22, 1979

[51] Int. Cl.[3] ..... B63H 25/00

[52] U.S. Cl. ..... 114/144 R; 74/480 B; 74/494; 74/625; 180/79.1; 192/71; 192/95; 280/774

[58] Field of Search ..... 74/494, 625, 480 B, 74/512, 10 A, 479, 481; 114/144 R, 144 RE, 144 A, 146, 153; 180/6.44, 6.28, 6.62, 11, 12, 79.1; 192/71, 95; 280/774; 251/130

[56] References Cited

U.S. PATENT DOCUMENTS

| | | | |
|---|---|---|---|
| 2,829,616 | 4/1958 | O'Brien et al. | 74/480 B X |
| 2,928,291 | 3/1960 | Wilkerson | 74/494 |
| 2,951,460 | 9/1960 | Pierson | 114/144 R |
| 3,002,398 | 10/1961 | Beamer | 74/494 X |
| 3,003,363 | 10/1961 | De Hart | 74/625 X |
| 3,570,439 | 3/1971 | Snelling | 114/146 |
| 3,613,624 | 10/1971 | Stauffer | 114/144 RE |
| 3,648,539 | 3/1977 | Rouis | 74/494 |
| 3,762,239 | 10/1973 | Rouis | 74/494 |
| 3,811,395 | 5/1974 | Decis | 114/144 R |
| 3,830,183 | 8/1974 | Menegus | 114/144 C |
| 3,895,545 | 7/1975 | Hunter | 74/494 |
| 4,130,079 | 12/1978 | Rhorer et al. | 114/146 X |

*Primary Examiner*—C. J. Husar
*Assistant Examiner*—Moshe I. Cohen
*Attorney, Agent, or Firm*—Arthur J. Hansmann

[57] ABSTRACT

A remote control steering attachment for a steering wheel wherein a driving motor is releasably attached to the steering wheel by means of a cross member adjustably bolted to the steering wheel. A clutch is interposed between the driving motor and the steering wheel so that the steering wheel can be operated when the unit is declutched and the driving motor is not being used. A remote control is used for controlling the driving motor and thus turning the steering wheel from a location distant from the steering wheel.

9 Claims, 5 Drawing Figures

62
49
59
56
59
61
4
4
62
54
57
52
53
49
58
51
27
29
32
38
41
31
37
28
39
47
43
64
66
46
42
63
44
33
69
67
36
48
34
68
67
69
68
34

REMOTE CONTROL STEERING ATTACHMENT FOR A STEERING WHEEL

This invention relates to a remote control steering attachment for a steering wheel having a center column and a wheel rim and the attachment is easily and readily attached and detached from the steering wheel, and the steering wheel can be used when the driving motor is declutched therefrom.

BACKGROUND OF THE INVENTION

The prior art is already aware of various arrangements for remote control of steering wheels. Examples of such prior art are found in U.S. Pat. Nos. 2,928,291 and 2,951,460 and 3,003,363 and 3,570,439 and 3,613,624 and 3,762,239 and 3,811,395 and 3,830,183, and 3,895,545. As will be seen in those patents, some of them pertain to a remote control device for turning the steering wheel of either a land vehicle or a boat. Others pertain to remote control devices for turning the steering apparatus of a boat. Since the present invention relates to a remote control attachment for turning a steering wheel of a boat, it will be discussed in that context. With repsect to the prior art patents, the disclosures which show driving motors or the like for controlling a steering wheel are different from that in the present instance in that they are either disposed off center with respect to the steering wheel or they are different and complex in their attachment to the steering wheel, and some of them are only for temporary attachment to the steering wheel and must be removed when the steering wheel is to be used without the remote control device connected therewith. In U.S. Pat. Nos. 2,928,291 and 3,570,439 and 3,895,545, those remote control steering devices are related to a steering wheel but they are arranged only to be used as the remote control device and they must be removed when the steering wheel itself is to be manually controlled. The same is true of U.S. Pat. No. 3,003,363 even though it shows a structure which is somewhat mounted co-axial with the steering column, though the driving motor is off center from the steering column. The present invention distinguishes over this art by having its driving motor coaxial with the steering column and having a clutch interposed between the driving motor and the steering wheel so that the steering wheel can be manually turned without requiring the removal of the driving motor but only necessitating the declutching of same by a simple maneuver of shifting a latch pin.

Further, the present invention provides a remote control steering mechanism which is readily and easily attached to a steering wheel, and which can be left on the steering wheel in the fully attached position when it is desired that the steering wheel be manually turned. Still further, the present invention provides a steering wheel remote control attachment which is adjustable for different diameters of steering wheel rims, and only the minimum apparatus, weight, and bulk are required for provision of this remote control device which is therefore suitable for a boat. Accordingly, the attachment of this device does not require that it be built into the boat or the like, and it need not be mounted on or connected with any part of the boat or like structure in any permanent manner, and the operator can still sit in front of the steering wheel and maneuver it in a usual manner without interference from any of the parts though they all remain in their operative position and can therefore be readily altered between the remote control mode and the manual steering mode, as desired.

Other objects and advantages will become apparent upon reading the following description in light of the accompanying drawings.

DETAILED DESCRIPTION OF THE PREFERRED EMBODIMENT

Figure 1:
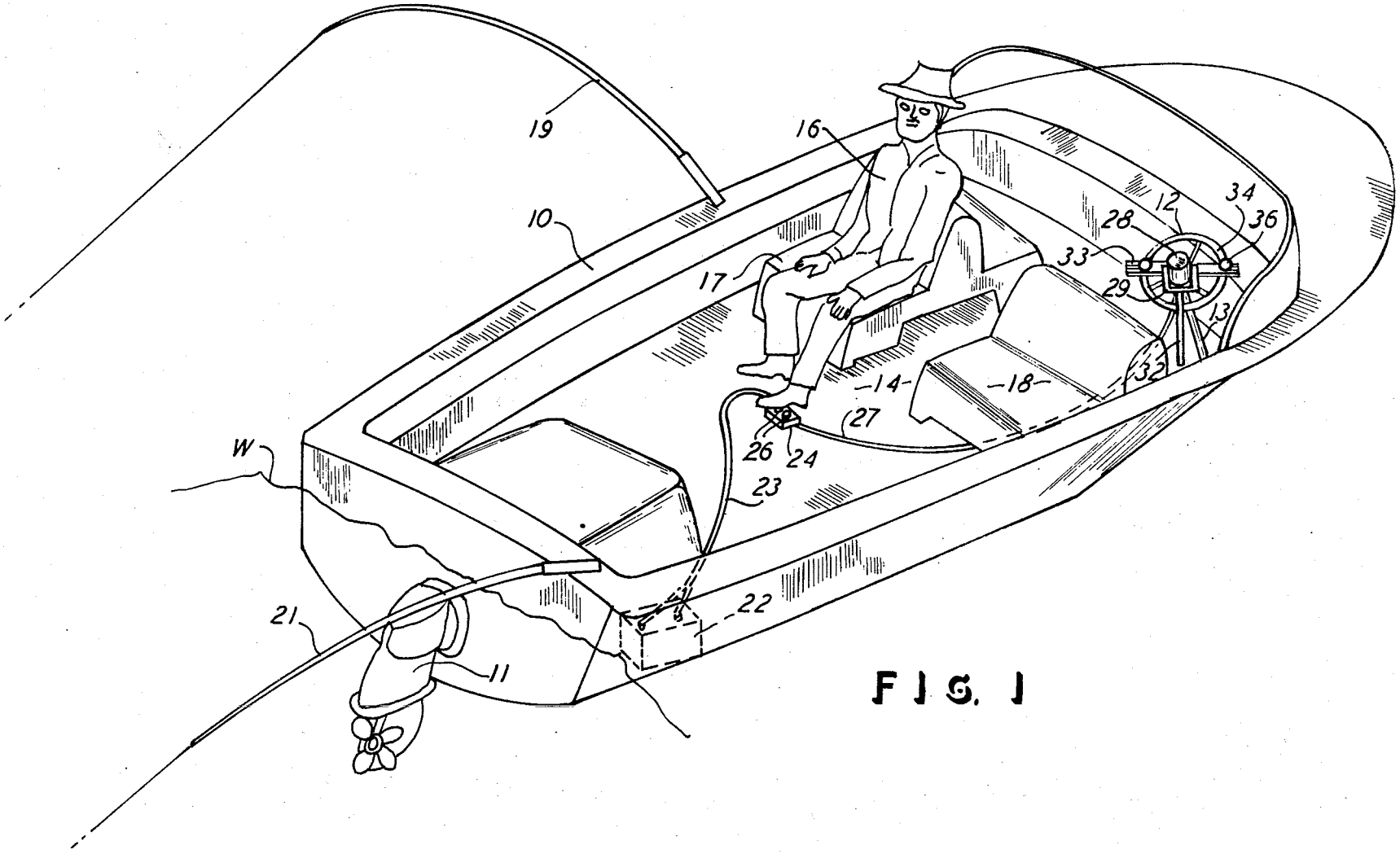
FIG. 1 is a perspective view of a boat having the remote control attachment apparatus of this invention incorporated therewith.

FIG. 1 shows this invention applied to a boat 10 which has the conventional motor 11 and steering wheel 12 supported on steering column 13 extending upwardly from the boat floor 14. It further shows an operator designated 16 and occupying a seat 17, and there is another seat 18 which includes a portion facing toward and adjacent the steering wheel 12 so that the operator could occupy that portion of the seat 18 in the usual control of the steering wheel 12 and thus the usual and conventional steering of the boat 10. The drawing further shows that the boat 10 is being used for fishing, and actually a trolling operation is going on, and the operator 16 is faced rearwardly in the boat and can watch the fishing poles 19 and 21 without being required to be forwardly faced in the boat and control the steering wheel 12, because of the incorporation of this invention, as hereinafter described. The water line W is also shown in FIG. 1.

An electric battery 22 is in the boat 10 and has a cable 23 connected therewith and extending to a remote control unit 24, in this instance a foot operated unit having two push buttons 26 which the operator 16 can depress by his foot and thus control the flow of current through the cable 23 and through another cable 27 which extends to a driving motor 28 which is in the form of an electric motor.

The motor 28 is in the nature of a cylindrical unit and extends co-axially with the steering column 13 and is disposed at an elevation above the plane of the conventional steering wheel 12. As will be further seen and understood in connection with FIG. 2, the motor 28 is mounted on the steering wheel 12, and there is a restrainer member 29, in the form of a yoke 31 and a rod 32 connected with the yoke 31 and extending down to the floor 14 to be attached to the floor, in any suitable manner such as by hooking onto a hook (not shown) on the floor 14. Also, the restrainer 29 could be anchored in any other fashion relative to the boat 10, and it simply is utilized to restrain the reaction torque created by the operation of the motor 28, in the usual manner and as will be well understood by anyone familiar with electric motors having a driving shaft extending thereon.

A cross member 33 extends endlessly across the steering wheel 12 and beyond the rim 34 of the steering wheel 12, as shown in FIG. 1. The cross member 33 is releasably attached to the rim 34 by means of the fasteners designated 36 and shown as spherical members in FIGS. 1 and 5.

It will thus be seen and understood that the cross member 33 is a member of rigid material, and it extends diametrically across the steering wheel rim 34 and serves as an interconnector between the motor 28 and the steering wheel 12. Further, the entire assembly is readily attached and detached relative to the conventional steering wheel 12, so one can readily and easily mount the remote control attachment of this invention and can also take it off the steering wheel 12, as desired. Further, the yoke 31 allows the motor 28 to pivot about the upper legs or arms of the yoke 31, but the motor 28 cannot rotate except for the rotation of its driving shaft, all as described in connection with FIG. 2. It will also be understood and described hereinafter that the steering wheel 12 can be used while the remote control attachment of the motor 28 and cross member 33 are still mounted as shown in FIG. 1, but without requiring that the motor shaft or armature be turned in turning of the steering wheel 12 or of course without requiring that the remote control attachment of this invention be taken off the steering wheel 12. Still further, it will be clearly understood that the electric switch unit 24 can be moved to any convenient position in the boat 10 and it can also be held in the hand where the buttons 26 can be operated for driving the motor 28 in either direction of rotation and thus steering the boat either to the left or the right, as desired.

Figures 2, 3, 4, 5:
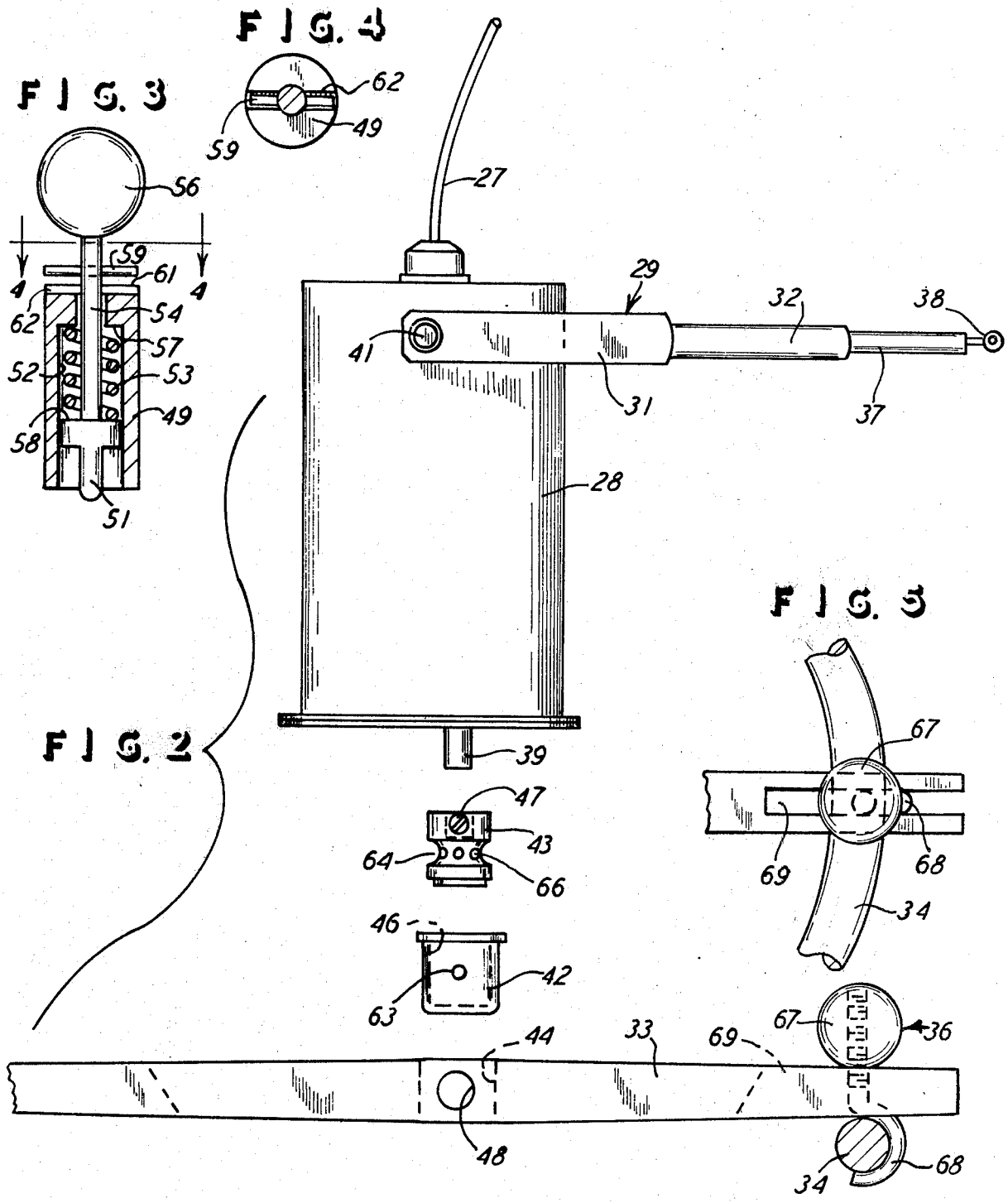
FIG. 2 is an exploded view of the remote control attachment parts shown in FIG. 1.
FIG. 3 is a side elevational view of the clutch pin used with the parts shown in FIG. 2, and shown enlarged.
FIG. 4 is a sectional view taken along the line 4—4 of FIG. 3.
FIG. 5 is a top plan view of a portion of FIG. 2.

FIG. 2 shows that the restrainer member 29 has a telescoping piece 37 which permits the length of the rod 32 to be altered for extending to the floor or any other remote point, as desired. Also, an eyelet member 38 is attached to the section 37 for anchoring to any part of the boat, such as a hook on the floor 14. FIG. 2 shows the motor 28 has its drive shaft 39 extending thereon in the conventional arrangement for the motor 28, and the usual gear reducers are within the motor 28. Also, it will now be seen that the yoke 31 has pivot pins 41 which connect to the motor 28 for properly permitting the motor 28 to be positioned relative to the center of the cross member 33 and co-axially with the steering column 13 or at least near the rotation axis of the steering wheel 12.

A detent assembly is utilized as a clutch member between the motor shaft 39 and the cross member 33, and it includes the housing piece 42 and the clutch body 43. The cross member 33 has a cylindrical hole 44 extending therethrough, and the housing 42 is also cylindrically shaped and is suitably secured in the opening 44, such as by pressing therein or by any conventional type of attachment. The member 42 is hollow to present a cylindrical interior 46 which receives the cylindrical clutch body 43 such that the two pieces 42 and 43 can rotate relative to each other and about their cylindrical axes described. The body 43 has a set screw 47 extending therein for non-rotatably attaching the body 43 to the extending motor shaft 39, in the usual arrangement, and thus the body 43 will rotate with the rotation of the shaft 39 at all times.

The cross member 33 has another cylindrical hole 48 extending transverse to the hole 44 and completely therethrough, and the hole 48 receives a detent body 49 shown in FIG. 3. The detent body is pressed into the hole 48 to be snug therewith and thus have the body 49 remain with the cross member 33, in any suitable manner of connecting the two. A detent pin or latch 51 is slidably mounted in the body 49 in the cylindrical opening 52 therein. A compression spring 53 urges the pin 51 downwardly, and there is a shaft 54 which is connected with the pin 51 and which has a head or knob 56 attached to the upper end of the shaft 54. Thus, a shoulder 57 in the body 49 is presented to the shoulder 58 on the pin 51 and thus prevents the pin 51 from being pulled upwardly out of the housing 49, and, conversely, the knob 56 prevents the assembly from being pulled downwardly through the housing 49. Thus, the detent or latch pin 51 slides up and down in the housing 49 and can project from the lower end of the housing 49 for the purpose of providing a rotation drive relation between the shaft 39 and the cross member 33 when desired. Also, a cross pin 59 extends through the shaft 54 and engages the upper surface 61 of the body 49 when the detent pin assembly is allowed to move downwardly under the force of the compression spring 53. In fact, the upper surface 61 has a groove 62 therein, as shown in FIG. 4, and the pin 59 can fit into the groove 62 when the knob 56 is properly rotated for so positioning the cross pin 59, and that permits the detent or latch pin 51 to project beyond the body 49 for extending through a pin opening 63 in the housing 42 and thus extend into a groove 64 in the clutch body 43. In fact, when the cross pin 59 is on the upper surface 61, the detent pin 51 projects through the hole 63 and into the groove 64 so that the motor 28 always remains connected with the cross member 33 through the interconnection of that detent pin 51 in the groove 64.

Next, when the cross pin 59 is further down on the body 49, that is when it is in the slot or groove 62, then of course the pin 51 projects further from the body 49 and through the opening 63 and actually engages one of a row of holes 66 in the body 43. In that position of engagement, the shaft 39 and the cross member 33 are rotatably secured together and thus the motor 28 can rotate the cross member 33 and thereby turn the steering wheel 12, as desired.

Therefore, it will be seen and understood that the operator can control the clutch mechanism just described, and that control is by virtue of positioning the latch pin 51 either into or out of the holes 66 by having the cross pin 59 either in the slot 62 or resting on the edge or upper surface 61. However, in all instances, the pin 51 will always be in the groove 64, and thus the motor 28 will always be attached with the cross member 33 but will not always be in rotational driving relation therewith, as mentioned.

Finally, the cross member 33 is readily and easily attached and detached relative to the steering wheel rim 34, and the drawings show that the attachment is by means of the fastener 36 which has its upper spherical knob 67 and a threaded hook 68 extending therefrom and partially around the steering wheel rim 34, as seen in FIG. 5. The cross member 33 has end slots 69 therein, and the hook 68 extends through the slot so that the cross member can be trapped between the knob 67 and the steering wheel rim 34, and this can be a tight connection simply by turning the knob 67 to thread it downwardly onto the hook 68 and thus clamp the cross member 33 between the knob 67 and the steering wheel rim 34. Further, by virtue of the elongated slots 69 in each end of the cross member 33, the attachment permits adjustable positioning of the fastener 36 and thus the attachment is adaptable to different sizes of steering wheel rim diameters.

Thus, the entire attachment permits ready and easy connection with the steering wheel 12, and it provides for attaching to different sizes of steering wheel rims 34, as mentioned. Further, when the clutch is in the de-clutched position, then the operator can use the steering wheel 12 without rotating it against the resistance of the motor 28 which is then in the de-clutched position. Still further, the operator can readily and easily place the attachment in the driving or connected position, simply by maneuvering the control knob 56 and placing the pin 59 either in the slot 62 or on the upper surface 61 for the respective driving and de-clutched positions, as mentioned. In this arrangement, it will be seen and understood that the driving motor 28 is in position of the usual horn button on a conventional steering wheel 12, that is, it is at least substantially co-axial with the steering wheel 12 and thereabove and is not otherwise in the way for sitting in front of the steering wheel 12 or maneuvering same.

The cross member 33 thus has the housing 42 affixed therewith, at least through the pin 51, and they serve as rotation mountings for the motor 28, so the motor 28 will remain mounted and ready for use.

What is claimed is:

1. A remote control steering attachment for a steering wheel having a center column and a wheel rim, comprising a driving motor to be disposed on the axis of said steering column, a source of power for said motor and connected therewith, a remote type of control connected with and between said motor and said source of power for controlling power to said motor, a cross member attachable to said steering wheel rim to rotate therewith and having said motor mounted on said cross member and connected therewith for rotating the latter in the steering of said steering wheel, a clutch interconnected between said motor and said cross member for selective drive connection and release between said motor and said cross member, and a restrainer member connected with said motor for securing said motor against its own reaction in driving said cross member.

2. The remote control steering attachment as claimed in claim 1, wherein said motor has a rotatable driving shaft extending thereon and which is positionable co-axial with said column, and said cross member has a recess therein for receiving said shaft.

3. The remote control steering attachment as claimed in claim 1 or 2, wherein said clutch includes a manually controlled piece connected with said cross member and a latch connected with said piece for setting and holding said piece in the de-clutched position.

4. The remote control steering attachment as claimed in claim 3, wherein said clutch includes a clutch body secured to said motor driving shaft and having a groove extending therearound and having pin holes spaced around said groove, and said piece is a pin positionable in said holes when said latch is released, for clutching action, and free of said holes when said latch is set, for declutching action, and said pin extending into said groove, when free of said holes, for rotatably holding said motor onto said cross member.

5. The remote control steering attachment as claimed in claim 1 or 2, including a threaded clamp connected to each end of said cross member for ready attachment and detachment of said cross member to said steering wheel rim.

6. The remote control steering attachment as claimed in claim 5, wherein said clamps are hooks extendable around said steering wheel rim to attach thereto.

7. The remote control steering attachment as claimed in claim 1 or 2, wherein said cross member is elongated and has a radially extending slot at each opposite end thereof, and a connector disposed in each of said slots and being movably positionable therealong for adjustable connection to different diameters of steering wheels.

8. The remote control steering attachment as claimed in claim 7, wherein said connectors are threaded clamps for ready and adjustable connection between said cross member and the steering wheel.

9. The remote control steering attachment as claimed in claim 1 or 2, including a boat having said steering wheel, and said restrainer member being adjustable in length for anchoring to said boat.

* * * * *